US007913991B2

(12) United States Patent
Okamoto

(10) Patent No.: US 7,913,991 B2
(45) Date of Patent: Mar. 29, 2011

(54) PRINTING APPARATUS AND PRINTING MEDIUM FEEDING METHOD

(75) Inventor: Akira Okamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 105 days.

(21) Appl. No.: 12/332,712

(22) Filed: Dec. 11, 2008

(65) Prior Publication Data

US 2009/0160126 A1 Jun. 25, 2009

(30) Foreign Application Priority Data

Dec. 19, 2007 (JP) ..... 2007-328028

(51) Int. Cl.
*B65H 5/00* (2006.01)
*B65H 5/34* (2006.01)

(52) U.S. Cl. ..... 271/10.03; 271/270; 271/10.12

(58) Field of Classification Search ..... 271/3.15–3.17, 271/10.02, 10.03, 10.11, 10.12, 270
See application file for complete search history.

(56) References Cited

U.S. PATENT DOCUMENTS

| | | | | |
|---|---|---|---|---|
| 5,738,349 | A * | 4/1998 | Shirasaki | 271/242 |
| 6,409,043 | B1 * | 6/2002 | Fujita et al. | 271/10.03 |
| 6,421,581 | B1 | 7/2002 | Hamamoto et al. | |
| 6,874,778 | B2 | 4/2005 | Nakano et al. | |
| 6,969,141 | B2 | 11/2005 | Horiuchi et al. | |
| 7,068,969 | B2 * | 6/2006 | Ueda | 399/388 |
| 7,292,819 | B2 * | 11/2007 | Ueda | 399/381 |
| 2001/0017440 | A1 * | 8/2001 | Minamishin et al. | 271/10.11 |
| 2008/0179812 | A1 * | 7/2008 | Hwamg | 271/3.09 |

FOREIGN PATENT DOCUMENTS

| | | | |
|---|---|---|---|
| JP | 05017050 | A * | 1/1993 |
| JP | 2002-187634 | | 7/2002 |
| JP | 2002-205838 | | 7/2002 |
| JP | 2004-82640 | | 3/2004 |

* cited by examiner

*Primary Examiner* — Stefanos Karmis
*Assistant Examiner* — Luis Gonzalez
(74) *Attorney, Agent, or Firm* — Fitzpatrick, Cella, Harper & Scinto

(57) ABSTRACT

To achieve a high-speed feeder, improvement of a rotational rate is required similarly in a feed motor and a conveyance motor, resulting in high costs. Moreover, in simultaneous control of paper feed and discharge, improvement of a conveyance rate leads to a high discharge rate to deteriorate alignment of discharged paper sheets. To solve the problems, the rate of the feed roller is set higher than the rate of the conveyance roller. The rate of the feed roller is determined based on the rate of the conveyance roller and an allowable amount of a loop formed by a rate difference between the two rollers. In the simultaneous control of paper feed and discharge, a distance between pages is detected by a sensor to determine whether the distance is sufficient, from the relation between current feed and conveyance rates. In the case of insufficient distance, the conveyance roller is stopped.

5 Claims, 7 Drawing Sheets

PRINTING APPARATUS AND PRINTING MEDIUM FEEDING METHOD

BACKGROUND OF THE INVENTION

1. Field of the Invention

The present invention relates to a printing medium feeding method for feeding a printing medium, which is a subject of conveyance, in association with a conveyance operation of conveying the printing medium to a predetermined print start position, and a printing apparatus.

2. Description of the Related Art

There is a printing apparatus that includes a device for feeding cut-sheet printing media one by one to a print position at which printing is carried out by a printing unit such as a printing head. Here, the printing media not only mean paper but also widely include sheet media made of various materials usable for printing, such as clothes and plastic films. In the following description, these printing media may be simply referred to as a sheet. In this regard, operations of feeding and discharging such a printing medium may also be referred to as paper feed and paper discharge, respectively.

A paper feeder of this type has a configuration in which conveyance force is given to a sheet S by bringing a paper feed roller 2 into pressure-contact with the sheet S as shown in FIGS. 5A to 5F, for example. Additionally, such a paper feeder has a configuration in which a conveyance load is given to the sheet S by a separation unit 7 including a separation pad, a separation claw, a separation projection, and the like, so as to separate only the uppermost sheet S among sheets S stacked on the paper feeder from sheets thereunder. The separated sheet S is conveyed to a conveyance roller 11 located at the upstream side in conveyance direction by clockwise rotation of the paper feed roller 2 (FIGS. 5A to 5C). When the paper feed roller 2 completes one rotation, the pressure-contact with the sheet S is released (FIG. 5E). After that, the sheet S is conveyed to a predetermined print start position only by the conveyance roller 11 (FIG. 5F).

Japanese Patent Laid-open No. 2002-205838 discloses a sheet feeder in which a sheet is conveyed after the sheet is started to be fed by a paper feed roller and then abuts a stopped conveyance roller for registration. The sheet makes a loop by being pressed to the conveyance roller. After that, a position of the sheet is corrected so that the leading edge of the sheet can be parallel with the conveyance roller. Then, the sheet is conveyed by the paper feed roller and conveyance roller to the print start position. In the following description, such a paper feeding method is referred to as "registration paper feed".

In addition, Japanese Patent Laid-open No. 2002-187634 discloses a method in which conveyance roller is configured to have already started rotating by the time a leading edge of a sheet started to be fed by a paper feed roller reaches the conveyance roller, and then the sheet is conveyed to a print start position with no interruption. At this time, in order to supply a sheet without causing paper jam, the paper feed and the conveyance rollers are rotated at the same rate. In the following description, this paper feeding method is referred to as "non-registration paper feed" after Japanese Patent Laid-open No. 2002-187634. Although accuracy of positioning a sheet to a print start position with the "non-registration paper feed" is lower than that with the "registration paper feed," there is an advantage that time required for feeding can be reduced.

Japanese Patent Laid-open No. 2004-082640 discloses "simultaneous control of paper feed and discharge" in which a paper discharge operation of an already-printed sheet (current page) and a paper feeding operation of a sheet to be printed next (next page) are simultaneously carried out, when printing is continuously carried out on multiple sheets. If this control is applied to "non-registration paper feed," as shown in FIG. 7A, an image is printed on a sheet SA being the current page, and feeding of a sheet SB being the next page is started at the timing when printing of final data onto the sheet SA is completed (FIG. 7B). Thereby, the operation of discharging the sheet SA being the current page and the operation of conveying the sheet SB being the next page to a print start position can be simultaneously carried out (FIGS. 7B to 7G). As a result, a distance between the trailing edge of the sheet SA being the current page and the leading edge of the sheet SB being the next page is set to be small, so that a printing rate of continuous printing on multiple sheets can be improved.

However, in order to carry out printing at a higher rate in the above-described "non-registration paper feed", rotational rates of both the paper feed and the conveyance rollers need to be improved similarly to each other. For this reason, it is also necessary to improve performances of a feed motor, which is a driving source for the paper feed roller, and a conveyance motor, which is a driving source for the conveyance roller. However, this results in an increase of the manufacturing cost of the printing apparatus. There is also a problem, particularly a problem with the conveyance motor, that a temperature rise causes a reduction in torque when an inexpensive motor is used, because the conveyance motor continues to perform a conveyance operation even when an image with a small amount of data is continuously printed.

In addition, in order to carry out printing at a higher rate in the above-described "simultaneous control of paper feed and discharge", rotational rates of both the paper feed and the conveyance rollers have to be improved similarly to each other. Accordingly, the rate of discharging the sheet being the current page is also increased and the discharged sheets are untidily stacked on a paper tray or the like. As a result, this causes a problem of deteriorating alignment of discharged sheets. Furthermore, if printing data is present near the trailing edge of the sheet, there arises a problem that a distance between the trailing edge of the sheet being the current page and the leading edge of the sheet being the next page cannot be reduced.

SUMMARY OF THE INVENTION

An object of the present invention is to improve a feed rate of printing, and, eventually, improve throughput of printing by performing an appropriate and high-speed paper feed operation in association with a conveyance operation of conveying a printing medium to a predetermined print start position.

In addition to the above-described aspect, another object of the present invention is to suppress deterioration of alignment of discharged sheets.

In a first aspect of the present invention, there is provided a printing apparatus in which a printing medium fed from a feed unit is conveyed by a conveyance unit to a print start position, and then an image is printed on the printing medium, comprising: a controller configured to control driving of the feed unit and the conveyance unit so that a feed rate of the printing medium fed by the feed unit is higher than a conveyance rate of the printing medium conveyed by the conveyance unit.

In a second aspect of the present invention, there is provided a printing apparatus in which while a precedent printing medium is conveyed by a conveyance unit, a following printing medium following the precedent printing medium is fed by a feed unit and then conveyed to a print start position by the conveyance unit, and thereafter, an image is printed on the following printing medium, comprising: a controller configured to control driving of the feed unit and the conveyance unit so that a feed rate of the following printing medium fed by the feed unit is higher than a conveyance rate of the precedent printing medium conveyed by the conveyance unit.

In a third aspect of the present invention, there is provided a printing medium feeding method for a printing apparatus in which a printing medium fed from a feed unit is conveyed by a conveyance unit to a print start position, and then an image is printed on the printing medium, the method comprising the step of: controlling driving of the feed unit and the conveyance unit so that a feed rate of the printing medium fed by the feed unit is higher than a conveyance rate of the printing medium conveyed by the conveyance unit.

In a fourth aspect of the present invention, there is provided a printing medium feeding method for a printing apparatus in which while a precedent printing medium is conveyed by a conveyance unit, a following printing medium following the precedent printing medium is fed by a feed unit and then conveyed to a print start position by the conveyance unit, and thereafter, an image is printed on the following printing medium, the method comprising the step of: controlling driving of the feed unit and the conveyance unit so that a feed rate of the following printing medium fed by the feed unit is higher than a conveyance rate of the precedent printing medium conveyed by the conveyance unit.

According to the first or third aspect of the present invention, a printing medium is fed at a higher feed rate (Va) than a conveyance rate (Vb) of a conveyance unit without causing paper jam during the time from start of feeding the printing medium till arrival of the printing medium at the conveyance unit. Thus, the feed rate, and eventually, the throughput of printing can be improved.

In addition, according to the second or fourth aspect of the present invention, the feed rate (Va) of feeding a printing medium can be improved without causing paper jam and increasing the paper discharge rate (Vb) of discharging the printing medium. Thus, the feed rate thereof, and, eventually, the throughput of printing can be improved. Furthermore, the alignment of the discharged printing media is not deteriorated.

Further features of the present invention will become apparent from the following description of exemplary embodiments (with reference to the attached drawings).

DESCRIPTION OF THE EMBODIMENTS

The present invention will be described below in detail with reference to the accompanying drawings.

(Configuration of a Printing Apparatus)

Figure 1:
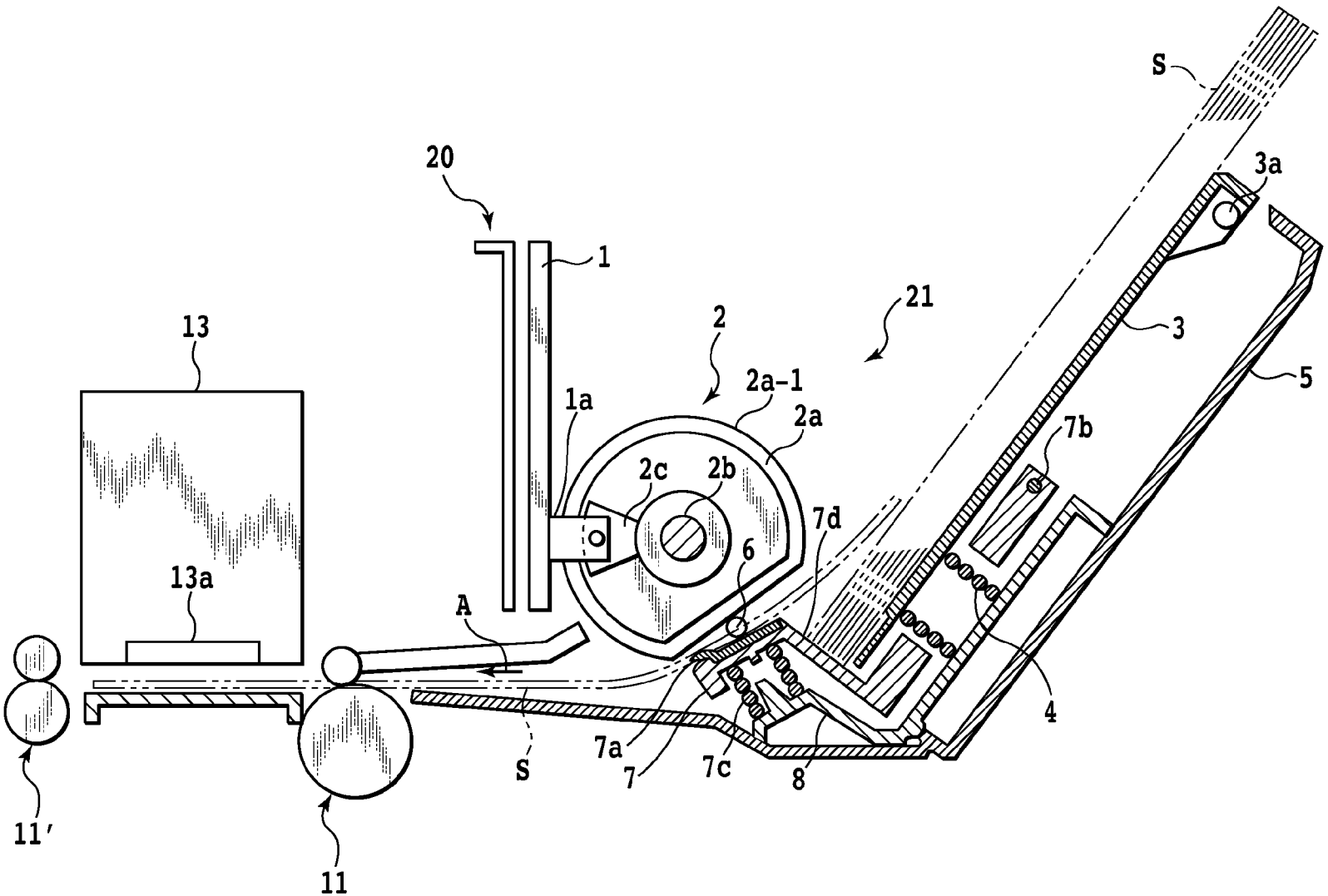
FIG. 1 is a cross-sectional view of an essential part, showing a schematic configuration of a printing apparatus according to an embodiment of the present invention.
Figure 2:
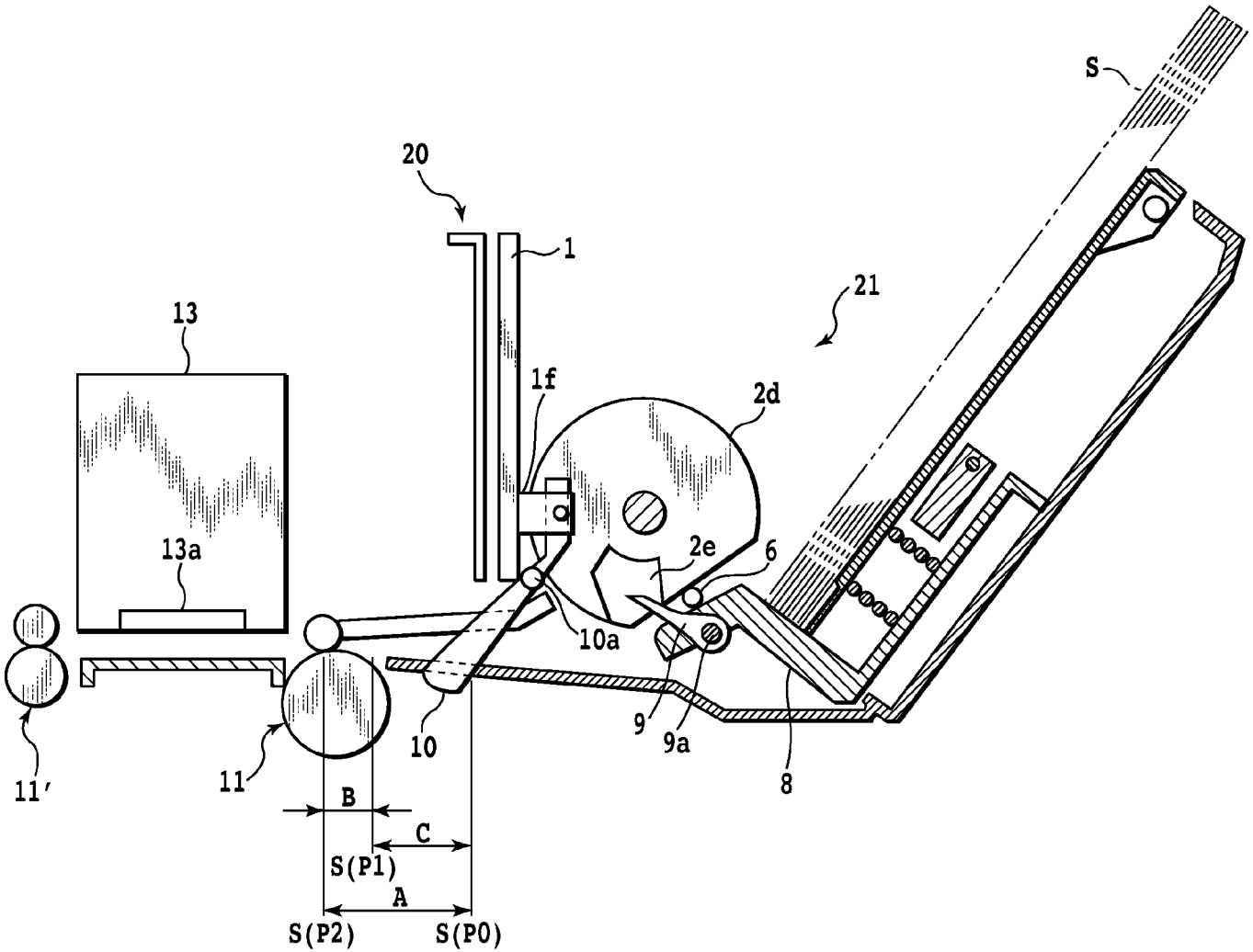
FIG. 2 is a cross-sectional view of the printing apparatus, in a portion different from FIG. 1, according to the embodiment of the present invention.

FIG. 1 is a cross-sectional view of an essential part showing a schematic configuration of a printing apparatus according to an embodiment of the present invention. Similarly, FIG. 2 is a cross-sectional view in a different portion of the printing apparatus according to the embodiment of the present invention.

In FIG. 1, reference numeral 20 denotes a printing apparatus. This printing apparatus 20 includes a printing head unit 13, which is an image forming unit, a feeder 21 which feeds a sheet (printing medium) S to a position facing the printing head unit 13, a main board 1 on which a control unit and the like controlling the entire printing apparatus 20 are mounted. A printing head 13*a* is mounted on the printing head unit 13. The arrow A denotes a feeding direction of a sheet with respect to the printing head unit 13.

The feeder 21 includes a feed roller 2, a hopper 3, and a separation pad unit 7. The feed roller 2 is a sheet feed unit which sends out sheets S stacked on a sheet loading unit and has an approximately semi-circular shape in cross-section. The hopper 3 brings a sheet S into contact with the feed roller 2. The separation pad unit 7 is a separation unit for separating the sheet S which is sent out by the feed roller 2 and includes a separation pad 7*a*.

The feed roller 2 includes a roller rubber 2*a*, a roller shaft 2*b*, a sensor flag 2*c*, and an unillustrated cam which presses the hopper 3 down. These elements integrally rotate around the roller shaft 2*a*. The roller rubber 2*a* comes in contact with the surface of a sheet S and the roller shaft 2*b* serves as the rotational center of the feed roller 2. The sensor flag 2*c* is to shield an optical path of a transmission-type feed roller sensor 1*a* provided on the main board 1. The feed roller sensor 1*a* is a position detecting unit for detecting a rotational position of the feed roller 2. The hopper 3 is configured to contact or be separated from the feed roller 2 along with the rotation of the feed roller 2, and brings the sheet S into contact with the feed roller 2 by elastic force of a pressure-contact spring 4 only when an arc portion 2*a*-1 of the roller rubber 2*a* faces the sheet S. The operation of bringing the hopper 3 into contact with or separation from the feed roller 2 is performed by the unillustrated cam included in the feed roller 2 and the pressure-contact spring 4.

Reference numeral 5 denotes a base for rotatably holding the hopper 3 via the shaft 3*a*. Reference numeral 8 denotes a separation base, which is held by the base 5 so as to be movable in a direction perpendicular to the sheet feed direction (hereinafter, also referred to as "a sheet width direction"). The separation pad unit 7 is attached to the separation base 8 so as to rotate around the rotational shaft 7*b*. Reference numeral 7*c* denotes a separation pad spring. The separation pad unit 7 is biased by the separation pad spring 7*c* in the direction of the feed roller 2.

FIG. 1 shows a sheet passing state where one separated sheet S is sent out. At this time, a flat portion of the feed roller 2 and the separation pad 7*a* are substantially parallel. The separation pad 7*a* is stopped at a position away from the feed roller 2 by an unillustrated stopper unit. Only a vicinity of the circumferential portion of the feed roller 2 (arc portion 2*a*-1 of the roller rubber 2*a*) is configured to abut on the separation pad 7*a*.

Reference numeral 6 denotes a roller which abuts on the separation pad 7*a* thereby to regulate a stop position where the sheet S is to be stopped. This roller 6 is provided at a position displaced from the feed roller 2 in the width direction of the sheet S and is lightly pressed against the separation pad 7*a* by an unillustrated spring so that rotation of the roller 6 would not be disturbed. In this manner, lightly pressing the roller 6 against the separation pad 7*a* causes the separation pad 7*a* to press sheets S including the second sheet and following ones which move together with the first sheet S fed when a sheet S is sent out.

In FIG. 2, reference numeral 9 denotes a return claw as a sheet return unit. This return claw 9 is provided at a position displaced from the feed roller 2 and the roller 6 in the width direction of the sheet S, and is rotatably held by the separation base 8 via the rotational shaft 9*a*. This return claw 9 is positioned so as to tilt toward the left as shown in FIG. 2 when a sheet S is fed. When the sheet S is returned (hereinafter, also referred to as "sheet return"), or before feeding of the sheet S is started, the return claw 9 is held at a position where the return claw 9 is rotated to the right so as to make a substantially right angle with the separation pad 7*a* by using unillustrated spring and stopper.

Reference numeral 2*d* denotes a return claw cam unit provided on a side of the feed roller 2, and has a recessed portion 2*e* formed therein. When a sheet is returned, or before feeding of the sheet S is started, the tip end of the return claw 9 enters the recessed portion 2*e*. Thereby, the return claw 9 is located at a position so as to make a substantially right angle with the separation pad 7*a*. Reference numerals 11 and 11' denote an upstream side and a downstream side conveyance rollers in the conveyance direction, respectively, which are component of a conveyance units which convey a fed sheet S or discharge a printed sheet S to the outside of the apparatus. Reference numeral if denotes a transmission-type sheet edge detection sensor (PE sensor) provided on the main board 1. The PE sensor is a sheet edge detection unit for detecting the leading edge and trailing edge of the sheet S to generate edge detection information. Reference numeral 10 denotes a lever-like actuator which rotates around a shaft 10*a* by being pressed by the conveyed sheet S. The PE sensor if detects the leading edge and trailing edge of the sheet S by rotation of the actuator 10.

Figure 3:
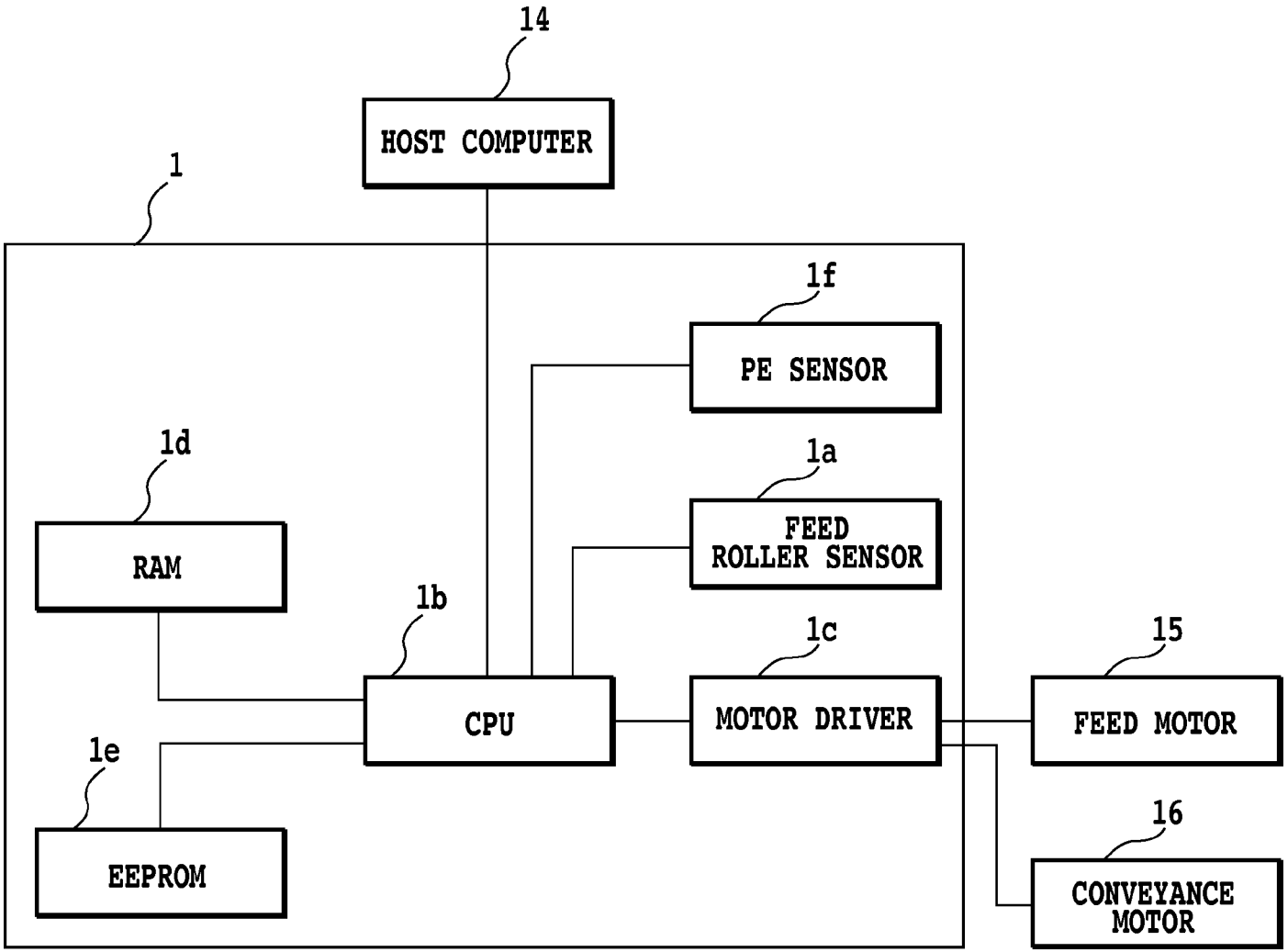
FIG. 3 is a block diagram showing a driving control system of the printing apparatus, particularly a feed and conveyance mechanism of the printing apparatus according to the embodiment of the present invention.

FIG. 3 is a block diagram for illustrating a driving control system of a feed motor 15 for rotating the feed roller 2 and a conveyance motor 16 for rotating the conveyance rollers 11 and 11'. In the present embodiment, both the feed motor 15 and the conveyance motor 16 are stepping motors.

Reference numeral 1*b* denotes a CPU as a controller, which is arranged on the main board 1 and controls the entire printing apparatus 20. Reference numeral 1*c* denotes a motor driver for controlling the feed motor 15 and the conveyance motor 16. Reference numeral 1*d* denotes a RAM for temporarily storing constants and the like. Reference numeral 1*e* denotes an EEPROM for storing operational parameters of the printing apparatus 20 such as control tables of the feed motor 15 and the conveyance motor 16 even when the power of the printing apparatus 20 is turned off. Reference numeral 14 denotes a host device, such as a computer, provided outside the printing apparatus 20. The host device 14 is a supply source of image data relating to printing and sends a print instruction together with the image data to the CPU 1*b*. In addition, this print instruction may include an instruction of a printing mode which will be described later. Note that, this type of device may be integrally provided to the printing apparatus (for example, inside the printing apparatus).

(Outline of a Printing Operation)

Next, an outline of a printing operation carried out in the printing apparatus 20 having the above-described configuration will be described.

When the CPU 1*b* receives a print instruction from the host device 14, the CPU 1*b* firstly determines if the print instruction is for the first sheet S. If the print instruction is for the first sheet S, the feed motor 15 is rotated forwardly by the motor driver 1*c* to cause the feed roller 2 to rotate clockwise as in FIG. 1. Thereby, the feeding of the sheet S is started. Along with the rotation of the feed roller 2, abutment between an unillustrated cam unit and the hopper 3, which are provided in the feed roller 2, is released. Then, the hopper 3 is rotated toward the feed roller 2 by the biasing force of the pressure-contact spring 4. As a result, a stack of sheets S on the hopper 3 are pressed onto the feed roller 2. Several sheets on top of the stack of sheets are conveyed and the conveyed sheets are started to be fed to the separation pad portion 7. In other words, the leading edges of the sheets S stacked on the hopper 3 are positioned so as to abut a back surface wall 7*d* of the separation pad unit 7. The several sheets S are started to be conveyed from that position.

At this time, the sensor flag 2*c* also rotates together with the rotation of the feed roller 2. Thereby, the output of the feed roller sensor 1*a* changes from ON to OFF. The CPU 1*b* takes the change of the output of the feed roller sensor 1*a* as a start point for rotational position control of the feed roller 2.

The several conveyed sheets S are guided into a nip portion between the feed roller 2 and the separation pad 7*a*. Then, leading edges of the sheets S under the uppermost sheet S are regulated by the separation pad 7*a* and treated so as to be gradually separated from the uppermost sheet S. Consequently, only the uppermost sheet S is separated and conveyed in the arrow A direction. At this time, the return claw 9 is pressed by the leading edge of the sheet S to rotate counter-clockwise, and thus does not disturb the movement of the sheet S.

The leading edge of the uppermost sheet S thus separated as a single sheet reaches the position of the actuator 10, so that the actuator 10 is rotated clockwise. Along with this, an end of the actuator 10 moves off from the shielding portion of the PE sensor if. Thereby, the PE sensor if can detect the leading edge of the sheet.

A detection signal from the PE sensor if is inputted to the CPU 1*b*. The CPU 1*b* takes the timing of the input as a start point for starting forward rotation of the conveyance motor 16 (counter-clockwise rotation of the conveyance roller 11) caused by the motor driver 1*c*. In addition, the timing of the input of the detection signal is also a start point for an operation of conveying the sheet S to conveyance roller 11 and further conveying the sheet S to a print start position by the conveyance roller 11. The conveyance motor 16 is generally controlled to obtain the same conveyance rate of the conveyance rollers 11, 11' as the feed rate of the feed roller 2. Further rotation of the feed roller 2 causes the leading edge of the sheet S fed into the printing apparatus 20 to be conveyed by the conveyance roller 11 forwardly rotating at the same circumferential rate as that of the feed roller 2.

Then, the unillustrated cam of the feed roller 2 presses the hopper 3 down. The feed roller 2 stops one rotation as shown in FIG. 1, and the feeding operation of the sheet S is completed. At this time, the rotation of the feed roller 2 is stopped by taking the timing of the output of the feed roller sensor 1*a* being ON as a start point for stopping the rotation of the feed roller 2. Note that, it is also possible that OFF of the feed roller sensor 1*a* at the timing of starting the rotation of the feed roller 2 may be taken as the start point for stopping the rotation of the feed roller 2.

After that, the sheet S is conveyed to the print start position by the conveyance roller 11 driven by the conveyance motor 16 to search a top position to be printed so that an image is printed by the printing operation of the printing head 13*a* based on the printing data. The print start position is a position according to the printing data and is set at a print position facing to the printing head 13*a*.

Meanwhile, sheets S other than the uppermost sheet S on which an image is thus printed are also fed to some extent together with the uppermost sheet S because of friction between the sheets S and the uppermost sheet S. However, the sheets S other than the uppermost sheet S are not fed further because leading edges thereof are pressed at the pressure contact portion (stopped position) between the roller 6 and the separation pad 7*a*. Such a configuration prevents multi-feeding of the sheets S.

Note that, the foregoing description is about the basic printing operation of the printing apparatus 20. During the process of the printing operation, characteristic feeding operation to be described later is carried out in the present embodiment.

The printing apparatus 20 can be implemented as a serial scan-type apparatus or a full-line-type apparatus. In addition, the printing method is not particularly limited, and various methods can be used. For example, a printing head of an inkjet printing head type, which ejects ink, can be used.

There are various kinds of ink ejection methods also in the inkjet printing head. For example, a method in which ink is ejected by using an electrothermal transducer element (heater) or a piezoelectric element can be used. If the electrothermal transducer element is used, an ink bubble by thermal energy generated by the electrothermal transducer element, and the ink is ejected from an ink ejection opening by utilizing the bubbling energy generated at that time.

For example, if a serial scan-type printing apparatus employing, for example, an inkjet printing head is used, a printing head 13*a* in which ejection openings are arranged in a predetermined direction is used. Operation of moving the printing head 13*a* along the width direction of the sheet S (direction different from the arrangement direction of the ejection openings) and operation of conveying the sheet S by a predetermined amount in a direction intersecting with the moving direction of the printing head are alternately repeated thereby to print an image on the sheet S. Meanwhile, if a full-line-type printing apparatus employing an inkjet printing head is used, a long printing head 13*a* which extends in the width direction of the sheet S and has ejection openings arranged in the width direction is used. An image is formed by ejecting ink onto the sheet S from the printing head 13*a* while continuously conveying the sheet S.

(Feed Control According to the Present Embodiment)

Figure 4:
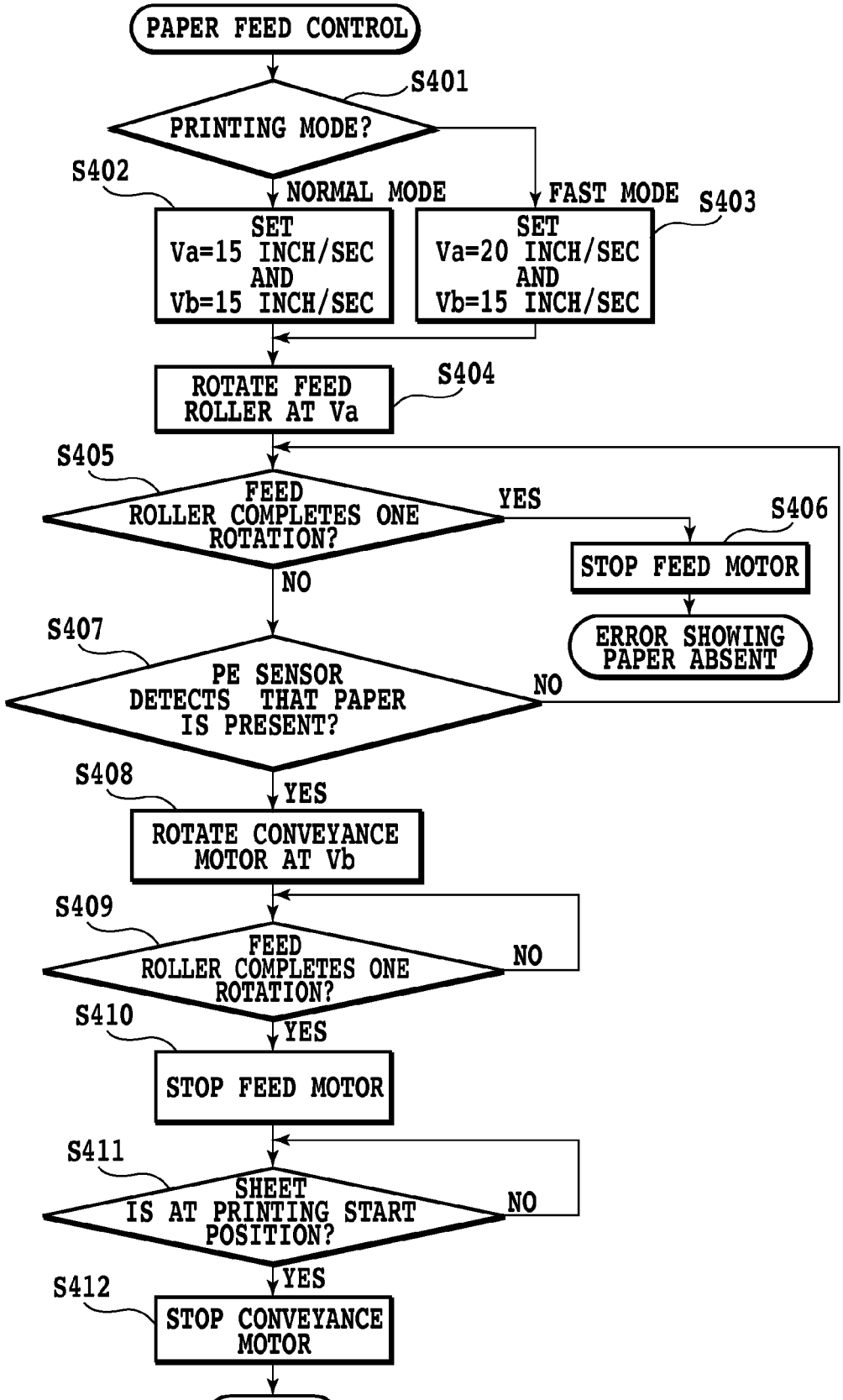
FIG. 4 is a flowchart showing an example of feed control procedures in the printing apparatus according to the embodiment of the present invention.

FIG. 4 is a flowchart for illustrating a procedure of characteristic feed control employed in the present embodiment.

As described above, the host device 14 sends a print instruction together with image data relating to printing. The print instruction can include designation of a printing mode. Here, the printing mode means a normal mode for carrying out printing at a similar rate to that of conventional printing and a fast mode for carrying out printing at a higher rate than that of conventional printing. A user can, at the user's discretion, designate a kind of printing medium, a size, a printing quality and the like, and also selectively can set these modes through a setting screen of a printer driver, which runs on an operating system of the host device 14, for example, in a form of a computer.

In the printing apparatus 20, the designated printing mode is firstly determined upon receipt of a print instruction together with image data (step S401). Here, if the designated mode is a normal mode, the operation proceeds to step S402. By contrast, if the designated mode is a fast mode, the operation proceeds to step S403.

In step S402, the setting for carrying out the operation of the normal mode is made. In other words, driving conditions of the feed motor 15 and the conveyance motor 16 are set so that both the feed rate Va and conveyance rate Vb of a sheet would be 15 inches per second. This is for carrying out printing at a similar rate to that of conventional printing. By contrast, in step S403, driving conditions of the feed motor 15 and the conveyance motor 16 are set so that the feed rate Va would be 20 inches per second and the conveyance rate Vb would be 15 inches per second, for carrying out the operation of the fast mode which is a characteristic operation of the present embodiment.

After the setting in steps S402 and S403, the operation proceeds to step S404 to start rotation of the feed motor 15 under the condition under which the feed rate Va can be obtained. Then, by the time when the feed roller 2 completes one rotation (one turn), it is determined whether or not the PE sensor if detects the leading edge of the printing medium (if paper is present) (steps S405 and S407). Here, if it is determined that paper is present, the operation proceeds to step S408. By contrast, if it is not determined, by the time when the feed roller 2 completes one rotation, that paper is present, the operation proceeds to step S406. This means that the latter case occurs when a sheet S to be fed is absent. In this case, the feed motor 15 is stopped and the present procedure is finished as an error showing that paper is absent. Note that, such an error can be notified to the user through a lamp or a buzzer provided to the printing apparatus 20, the display screen of the host device 14 or the like.

If it is determined that paper is present, in step S408, the conveyance motor 16 starts rotation under the condition under which the conveyance rate Vb can be obtained. After the completion of one rotation of the feed roller 2 (step S409), the feed motor 15 is stopped (step S410). Subsequently, after the sheet reaches a print start position (step S411), the conveyance motor 16 is stopped (step S412). Then, the present procedure as feed control is finished. In the following procedure, a well-known printing operation is carried out.

The process of conveying a sheet to a print start position in the fast mode by the above-described feed control will be descried with reference to FIGS. 5A to 5F showing sequential operational aspects in the feed control.

Figure 5A:
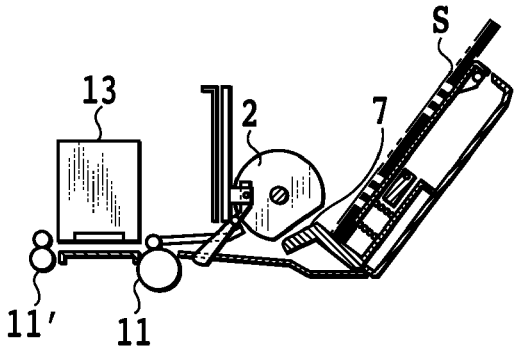
FIGS. 5A to 5F are cross-sectional views for illustrating processes of feeding a sheet according to the procedure in FIG. 4.

Before starting feeding, a sheet is set as shown in FIG. 5A. If it is determined in step S401 that the operation of the fast mode is designated, driving conditions of the feed motor 15 and the conveyance motor 16 are set so that a feed rate Va would be 20 inches per second and a conveyance rate Vb would be 15 inches per second, in step S403.

Figure 5D:
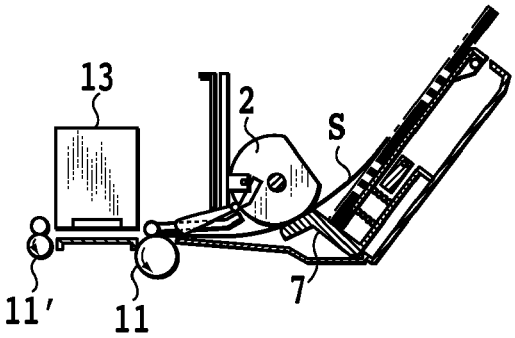
Figure 5B:
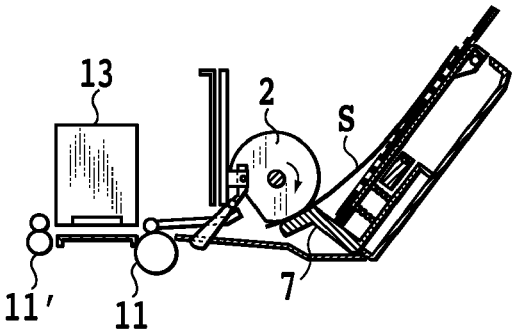

Then, when the feed motor 15 starts rotation (step S404), the feed roller 2 starts rotation as shown in FIG. 5B, and one sheet S is separated to be fed. After that, as shown in FIG. 5C, when the leading edge of the sheet S reaches the lever-shaped actuator 10 to activate the actuator 10, the PE sensor if detects that paper is present.

In step S408, when the conveyance motor 16 is rotated in response to the detection, the conveyance rollers 11, 11' start rotating. After that, the leading edge of the sheet S reaches the conveyance roller 11, the sheet S is conveyed by both the feed roller 2 and the conveyance roller 11, as shown in FIG. 5D. At this time, since the conveyance rate Vb is smaller than the feed rate Va, the sheet S gradually forms a loop between the feed roller 2 and the conveyance roller 11.

Figure 5E:
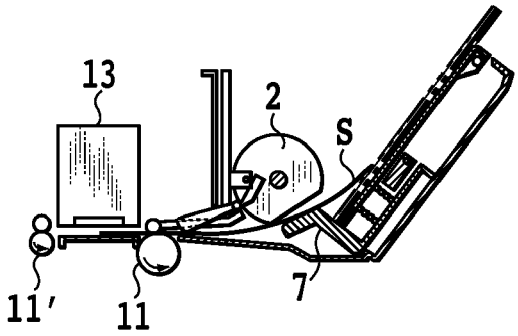
Figure 5C:
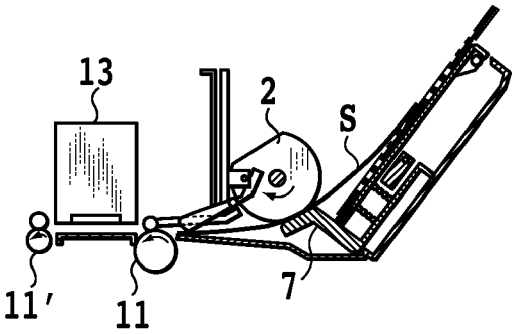

When the feed roller 2 completes one rotation, the feed roller 2 is separated away from the sheet S, as shown in FIG. 5E. Then, the loop formed between the feed roller 2 and the conveyance roller 11 is released in a backward direction to the feed roller 2. If it is determined in step S409 that the feed roller 2 completes one rotation, the operation proceeds to step S410 to stop the feed motor 15. Accordingly, the feed roller 2 is stopped.

Figure 5F:
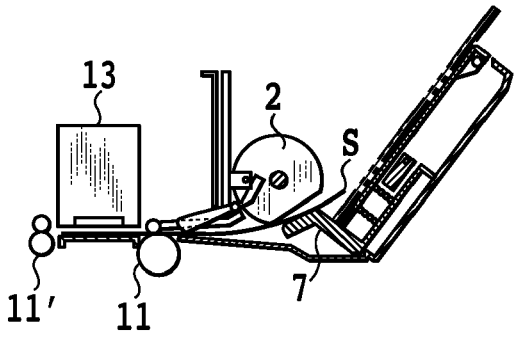

Lastly, as shown in FIG. 5F, when the sheet S reaches the print start position, it is determined in step S411 that the sheet S reaches the print start position. Then, the operation proceeds to step S412 to stop the conveyance motor 16. Accordingly, the feed control is finished.

Here, a method for determining a feed rate Va will be described. When the sheet S is conveyed by both the feed roller 2 and the conveyance roller 11, a maximum loop amount Lab is calculated by $$Lab=La\times(Va-Vb)\div Va$$

where La is a conveyed distance (partially-conveyed distance) conveyed only by the feed roller 2 in a sheet portion located on the upstream side of the conveyance roller 11 in the conveyance direction. If such Va is selected that the maximum loop amount Lab would be a loop amount Lab_max which is allowed by the shape and size of a feeding path and other mechanical configurations, a highest feed rate Va_max without causing paper jam can be selected. The following is a different way of expressing the above-described formula:

$$Va_\mathrm{max}=Vb\times La\div(La-Lab_\mathrm{max}).$$

For example, in the present embodiment, the partially-conveyed distance La is set to be 12 mm, the allowable loop amount Lab_max is set to be 3 mm, and the maximum value of the conveyance rate Vb is 15 inches per second. Accordingly, Va_max=20 in/sec which is calculated from these parameters is used as a feed rate in the fast mode, and the feed motor 15 is driven under the condition under which such a feed rate can be obtained.

According to the above-described feed control, the sheet S is conveyed at the feed rate Va=20 in/sec during the time from start of feeding the sheet S till arrival of the sheet S at the conveyance roller 11. Accordingly, required time for feeding is shortened than conventionally-required time and thus the throughput of printing is improved.

(Simultaneous Control of Paper Feed and Discharge)

Figure 6:
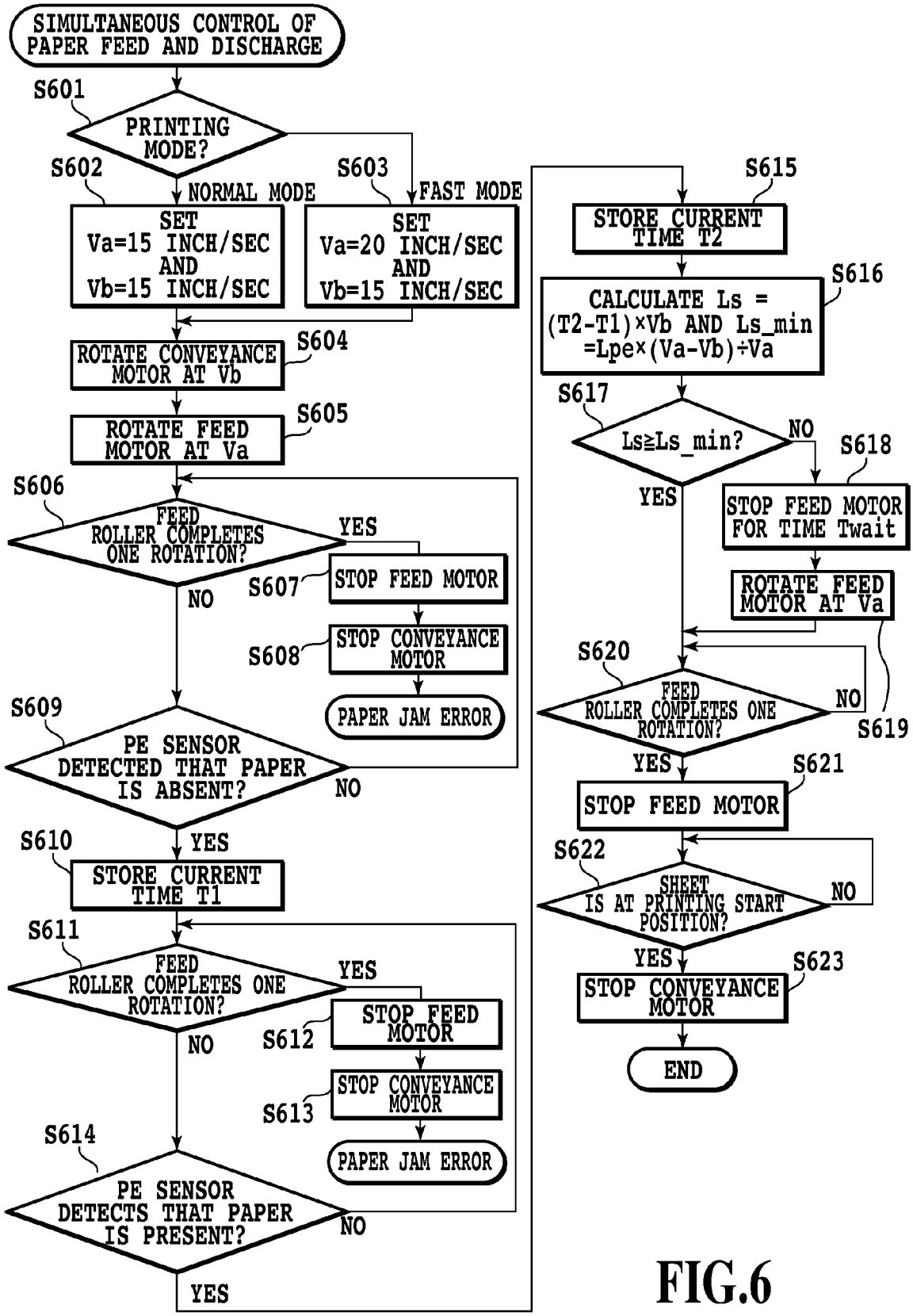
FIG. 6 is a flowchart showing an example of procedures of simultaneous control of paper feed and discharge in the printing apparatus according to the embodiment.

Next, with reference to FIG. 6, description will be given of the procedure of simultaneous control of paper feed and discharge with the configuration of the present invention.

In the present procedure, steps S601 to S603, which are respectively same as steps S401 to S403 in FIG. 4, are carried out. Setting of driving conditions of the respective motors in respective modes is also same as that of FIG. 4.

In the present embodiment, rotation of the conveyance motor 16 is started in step S604 under the condition under which the conveyance rate Vb can be obtained. Then, rotation of feed motor 15 is started in step S605 under the condition under which the feed rate Va can be obtained. After that, it is determined whether or not the PE sensor if detects that paper is absent (that is, whether or not it is detected that the trailing edge of a precedent sheet has past by the time when the feed roller 2 completes one rotation) (steps S606 and S609). If it is determined that paper is absent, the operation proceeds to step S610. By contrast, if it is not determined that paper is absent, both the feed motor 15 and the conveyance motor 16 are stopped (steps S607 and S608). The latter case occurs when a conveyance failure such as jam occurs, and thus the present procedure is finished after both the motors are stopped. Along with this, required notification can be made.

If it is determined in step S609 that paper is absent, the operation proceeds to step S610 to store a current time T1. After the current time T1 is stored, the operation proceeds to step S611. Then, it is determined whether or not the PE sensor if detects that paper is present (that is, whether or not the leading edge of the following sheet is detected) by the time when the feed roller 2 completes one rotation (one turn) (steps S611 and S614). If it is determined that paper is present, the operation proceeds to step S615. If it is not detected that paper is present by the time when the feed roller 2 completes one rotation, the operation proceeds to step S612. The latter case occurs when paper to be fed is absent. In this case, the feed motor 15 and the conveyance motor 16 are stopped (steps S612 and S613). Then, the present procedure is finished as an error showing that paper is absent.

If it is determined in step S614 that paper is present, the operation proceeds to step S615. A current time T2 is stored and then the operation proceeds to step S616.

In step S616, a current distance between sheets, that is, a distance Ls between the precedent sheet and the following sheet and the minimum sheet distance Ls_min are calculated by the following formulas:

$$Ls=(T2-T1)\times Vb$$

$$Ls_\mathrm{min}=Lpe\times(Va-Vb)\div Va.$$

After that, the operation proceeds to step S617. Here, Lpe is a distance from the PE sensor to the conveyance roller 11.

In step S617, it is determined if the sheet distance Ls is equal to or larger than the minimum sheet distance Ls_min. If the sheet distance Ls is smaller than the minimum sheet distance Ls_min, the operation proceeds to step S618. The feed motor 15 is stopped for the time Twait and the feed motor 15 is re-rotated at the feed rate Va (step S619), and then the operation proceeds to step S620. Here, the time Twait is time sufficient for the sheet, which is being discharged, to pass through the conveyance roller 11'. If the sheet distance Ls is equal to or larger than the minimum sheet distance Ls_min, the operation directly proceeds to step S620.

After the completion of one rotation of the feed roller 2 in step S620, the feed motor 15 is stopped (step S621). Subsequently, after the sheet reaches the print start position (step S622), the conveyance motor 16 is stopped (step S623). Then, the present procedure is finished.

The process of simultaneously discharging the sheet SA being a current page and conveying a sheet SB being the next page to the print start position in the fast mode by the above-described simultaneous control of paper feed and discharge will be described with reference to FIGS. 7A to 7G showing a sequential operational aspects in the simultaneous control of paper feed and discharge.

Figure 7A:
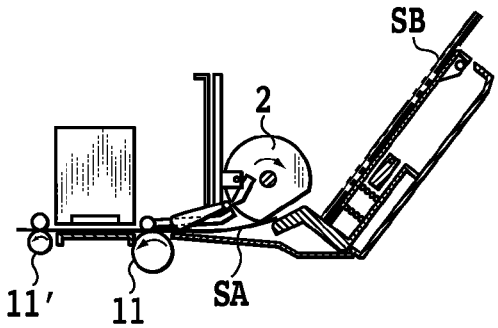
FIGS. 7A to 7G are cross-sectional views for illustrating processes of feeding a sheet according the procedure in FIG. 6.

Before the simultaneous control of paper feed and discharge is carried out, as shown in FIG. 7A, the sheet SA is located at a position where printing onto the sheet SA of the current page is complete, and the sheet SB of the next page is located at a position where the sheet SB is set. Note that, the present control is carried out only when the trailing edge of the sheet SA has been already conveyed to the downstream side of a predetermined position in the conveyance direction.

If it is determined in step S601 that the fast mode is designated, driving conditions of the feed motor 15 and the conveyance motor 16 are set in step S603 so that the feed rate Va would be 20 inches per second and the conveyance rate Vb would be 15 inches per second.

Then, the conveyance motor 16 starts rotating in step S604. The feed motor 15 starts rotating in step S605. After that, as shown in FIG. 7B, the conveyance rollers 11, 11' start rotating to cause the sheet SA to start being discharged at the conveyance rate Vb. At the same time, the feed roller 2 starts rotating to cause the sheet SB to be separated and conveyed at the feed rate Va.

Figure 7E:
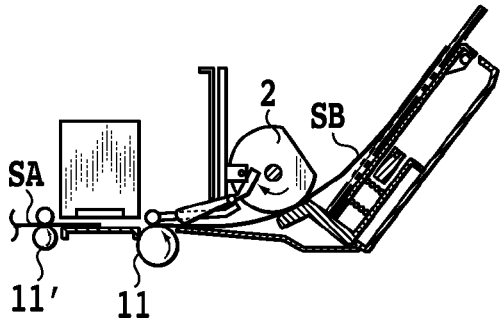
Figure 7B:
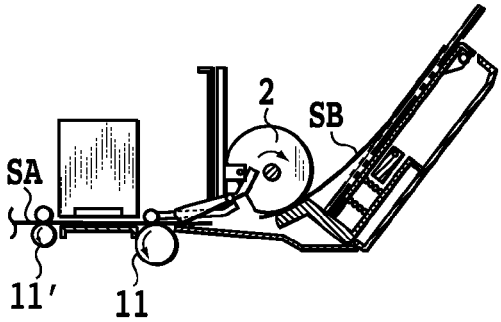
Figure 7F:
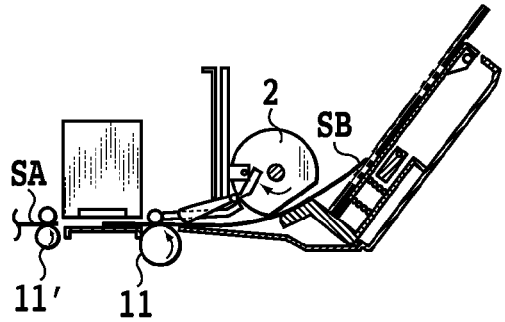
Figure 7C:
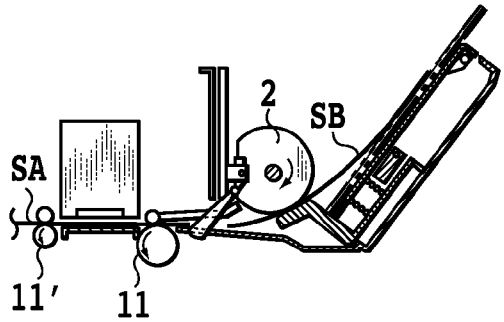

Thereafter, as shown in FIG. 7C, when the trailing edge of the sheet SA passes the actuator 10, it is determined in step S609 that paper is absent, and then a current time T1 is stored (step S610). Furthermore, as shown in FIG. 7D, when the leading edge of the sheet SB reaches the actuator 10, it is determined in step S614 that paper is present. Then, a time T2 is stored (step S615).

Furthermore, the current sheet distance Ls and the minimum sheet distance Ls_min are calculated and compared (step S616). Usually, it is determined that the current sheet distance Ls is equal to or larger than the minimum sheet distance Ls_min. Accordingly, the operation proceeds to step S620 without doing anything. By contrast, if it is determined that the current sheet distance Ls is smaller than the minimum sheet distance Ls_min because the sheet SB reaches the PE sensor earlier than usual, the operation proceeds to step S618. In step S618, the feed motor 15 is stopped for the time Twait to wait for the sheet SA to be discharged. Thereby, the sheet SB is prevented from contacting the sheet SA. Thereafter, in step S619, the rotation of the feed motor 15 is restarted under the condition under which the feed rate Va can be obtained.

After that, when the leading edge of the sheet SB reaches the conveyance roller 11, as shown in FIG. 7E, the sheet SB is conveyed by both the feed roller 2 and the conveyance roller 11. At this time, since the conveyance rate Vb is smaller than the feed rate Va, the sheet SB gradually forms a loop between the feed roller 2 and the conveyance roller 11. On the other hand, the sheet SA is continuously discharged at the conveyance rate Vb.

When the feed roller 2 completes one rotation, as shown in FIG. 7F, the feed roller 2 is separated away from the sheet SB. Then, the loop formed between the feed roller 2 and the conveyance roller 11 is released in a backward direction to the feed roller 2. After that, if it is determined in step S620 that the feed roller 2 completes one rotation, the operation proceeds to step S621 to stop the feed motor 15. Thus, the feed roller 2 is stopped.

Figure 7G:
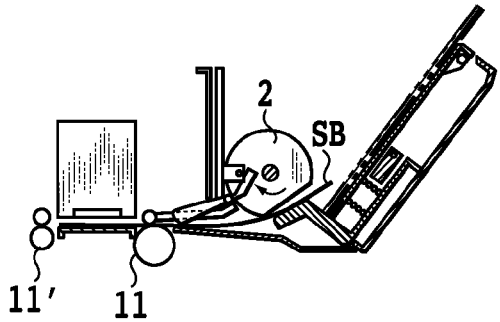
Figure 7D:
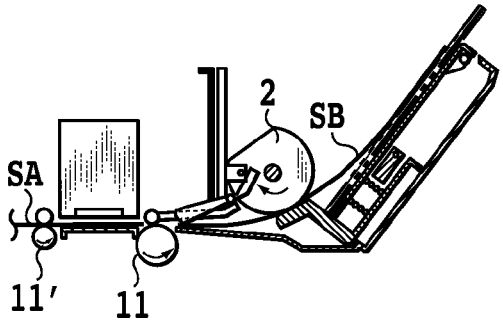

Finally, as shown in FIG. 7G, when the sheet SB reaches the print start position, it is determined in step S622 that the sheet SB reaches the print start position, and the operation proceeds to step S623 to stop the conveyance motor 16. Accordingly, the simultaneous control of paper feed and discharge is finished. Note that, the precedent sheet SA has been already discharged at the conveyance rate Vb in any of the processes described so far.

According to the above-described simultaneous control of paper feed and discharge, the following sheet SB is conveyed at the feed rate Va=20 in/sec during the time from start of feeding the following sheet SB till arrival of the following sheet SB at the conveyance roller 11. Accordingly, the time required for feeding is shortened than conventionally-required feeding time. Thus, improvement of the throughput of printing can be achieved. Furthermore, the precedent sheet SA is discharged at the low conveyance rate Vb=15 in/sec. Accordingly, a problem of discharged sheet alignment caused by the discharged sheets untidily stacked on a paper discharge tray or the like, can be alleviated. In addition, an appropriate feed operation is carried out by calculating the sheet distance La and comparing it with the minimum sheet distance considering the distance between the PE sensor and the conveyance roller. Accordingly, a disadvantage that causes the precedent sheet SA and the following sheet SB to collide with each other, is not caused. Thus, there does not arise a disadvantage of torn paper due to a jam or the like.

Note that, a method for determining the feed rate Va is similar to that of the above-described feed control.

In addition, in the foregoing description, the case of using two continuous sheets is described. However, the description can be applied to a case where additional following sheets are fed. Namely, even when printing is further carried out after the sheet SB, it is only needed to repeat a procedure similar to the above-described one.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-328028, filed Dec. 19, 2007, which is hereby incorporated by reference herein in its entirety.

What is claimed is:

1. A printing apparatus in which a printing medium fed from a feed unit is conveyed by a conveyance unit to a print start position, and then an image is printed on the printing medium, comprising:

a controller configured to control driving of the feed unit and the conveyance unit so that a feed rate of the printing medium fed by the feed unit is higher than a conveyance rate of the printing medium conveyed by the conveyance unit, wherein the controller determines the feed rate on the basis of the conveyance rate; a conveyed distance of the printing medium fed by the feed unit while the printing medium is conveyed by both the feed unit and the conveyance unit; and an allowable amount of a loop formed between the feed unit and the conveyance unit.

2. A printing apparatus in which while a precedent printing medium is conveyed by a conveyance unit, a following printing medium following the precedent printing medium is fed by a feed unit and then conveyed to a print start position by the conveyance unit, and thereafter, an image is printed on the following printing medium, comprising:

a controller configured to control driving of the feed unit and the conveyance unit so that a feed rate of the following printing medium fed by the feed unit is higher than a conveyance rate of the precedent printing medium conveyed by the conveyance unit, wherein the controller determines the feed rate on the basis of the conveyance rate; a conveyed distance for which the following printing medium fed by the feed unit is conveyed during a time period when the precedent printing medium is conveyed by both the feed unit and the conveyance unit; and an allowable amount of a loop formed between the feed unit and the conveyance unit.

3. A printing apparatus in which while a precedent printing medium is conveyed by a conveyance unit, a following printing medium following the precedent printing medium is fed by a feed unit and then conveyed to a print start position by the conveyance unit, and thereafter, an image is printed on the following printing medium, comprising:

a controller configured to control driving of the feed unit and the conveyance unit so that a feed rate of the following printing medium fed by the feed unit is higher than a conveyance rate of the precedent printing medium conveyed by the conveyance unit;

a detection unit configured to detect a trailing edge of the precedent printing medium conveyed by the conveyance unit and a leading edge of the following printing medium fed by the feed unit;

a determination unit configured to determine, when the detection unit detects the trailing edge of the precedent printing medium, whether or not the following printing medium contacts the precedent printing medium on the basis of edge detection information on the precedent and the following printing media detected by the detection unit, the feed rate, and the conveyance rate; and a unit configured to stop the feed unit based on the determination.

4. A printing medium feeding method for a printing apparatus in which a printing medium fed from a feed unit is conveyed by a conveyance unit to a print start position, and then an image is printed on the printing medium, the method comprising the step of:

controlling driving of the feed unit and the conveyance unit so that a feed rate of the printing medium fed by the feed unit is higher than a conveyance rate of the printing medium conveyed by the conveyance unit, wherein the controlling step determines the feed rate on the basis of the conveyance rate, a conveyed distance of the printing medium fed by the feed unit while the printing medium is conveyed by both the feed unit and the conveyance unit, and an allowable amount of a loop formed between the feed unit and the conveyance unit.

5. A printing medium feeding method for a printing apparatus in which while a precedent printing medium is conveyed by a conveyance unit, a following printing medium following the precedent printing medium is fed by a feed unit and then conveyed to a print start position by the conveyance unit, and thereafter, an image is printed on the following printing medium, the method comprising the step of:

controlling driving of the feed unit and the conveyance unit so that a feed rate of the following printing medium fed by the feed unit is higher than a conveyance rate of the precedent printing medium conveyed by the conveyance unit, wherein the controlling step determines the feed rate on the basis of the conveyance rate, a conveyed distance for which the following printing medium fed by the feed unit is conveyed during a time period when the precedent printing medium is conveyed by both the feed unit and the conveyance unit, and an allowable amount of a loop formed between the feed unit and the conveyance unit.

* * * * *